US010906094B2

(12) United States Patent
Nishihara et al.

(10) Patent No.: US 10,906,094 B2
(45) Date of Patent: Feb. 2, 2021

(54) DECOMPRESSION SHUT-OFF VALVE DEVICE AND METHOD FOR CONTROLLING SAME

(71) Applicant: HONDA MOTOR CO., LTD., Tokyo (JP)

(72) Inventors: Seigo Nishihara, Tochigi (JP); Takeshi Okada, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 35 days.

(21) Appl. No.: 16/362,888

(22) Filed: Mar. 25, 2019

(65) Prior Publication Data

US 2019/0291178 A1 Sep. 26, 2019

(30) Foreign Application Priority Data

Mar. 26, 2018 (JP) ..... 2018-058573

(51) Int. Cl.

| | |
|---|---|
| ***B22D 17/30*** | (2006.01) |
| ***B22D 18/02*** | (2006.01) |
| ***B22D 18/04*** | (2006.01) |
| *B22D 17/14* | (2006.01) |

(52) U.S. Cl.

CPC ..... *B22D 17/30* (2013.01); *B22D 18/02* (2013.01); *B22D 18/04* (2013.01); *B22D 17/14* (2013.01)

(58) Field of Classification Search

CPC .... B22D 17/14; B22D 17/2015; B22D 17/30; B22D 18/02; B22D 18/04

USPC ..... 164/457, 253, 254, 257, 305, 410

See application file for complete search history.

(56) References Cited

U.S. PATENT DOCUMENTS

| | | | | |
|---|---|---|---|---|
| 5,101,882 A * | 4/1992 | Freeman | ..... | B22D 17/145 164/254 |
| 5,540,272 A * | 7/1996 | Freeman | ..... | B22D 17/145 164/253 |
| 2015/0266087 A1* | 9/2015 | Gnali | ..... | B22D 17/2015 222/596 |

FOREIGN PATENT DOCUMENTS

| | | | |
|---|---|---|---|
| CA | 2 770 429 A1 * | 9/2013 | ..... B22D 18/06 |
| JP | 4892536 | 3/2012 | |
| JP | 5717692 | 5/2015 | |

* cited by examiner

*Primary Examiner* — Kevin P Kerns

(74) *Attorney, Agent, or Firm* — Rankin, Hill & Clark LLP

(57) ABSTRACT

Provided are a decompression shut-off valve device having high responsiveness and a method for controlling the same. The decompression shut-off valve device 10 includes an on-off valve 30, a detection pin 50, and an interlocking member 60 which operates the on-off valve 30 by displacement of the pressure-receiving section 52, a valve chamber 31, an accommodating chamber 17, and a cylinder 40 which accommodates an enlarged diameter section 37 provided in a rod section 33 of the on-off valve 30. The rod section 33 is slidably held through a second partition wall 18, and a rod end portion 36 of the rod section 33 is connected to the detection pin 50 via the interlocking member 60. The cylinder 40 is partitioned into a small diameter low-pressure chamber 80, and a large diameter high-pressure chamber 70 in which the working fluid having a higher pressure than the low-pressure chamber 80 is accommodated.

6 Claims, 3 Drawing Sheets

DECOMPRESSION SHUT-OFF VALVE DEVICE AND METHOD FOR CONTROLLING SAME

This application is based on and claims the benefit of priority from Japanese Patent Application No. 2018-058573, filed on 26 Mar. 2018, the content of which is incorporated herein by reference.

BACKGROUND OF THE INVENTION

Field of the Invention

The present invention relates to a decompression shut-off valve device and a method for controlling the same. More particularly, the present invention relates to a decompression shut-off valve device used in a decompression casting apparatus and a method for controlling the same.

Related Art

In related art, a decompression casting apparatus has been known as a casting apparatus capable of producing a casting having excellent mechanical properties. A suction mechanism such as a vacuum pump and an on-off valve are provided in the decompression casting apparatus in order to discharge and decompress the air in a cavity. The on-off valve has a function of blocking the cavity and a space provided with the suction mechanism or causing them to communicate with each other.

At the time of the suction using the suction mechanism, the on-off valve is closed to shut off the cavity and the space provided with the suction mechanism. This prevents the molten metal injected into the cavity from flowing into the suction mechanism. A response valve is provided to detect a relative position between the molten metal and the suction mechanism. The on-off valve closes when the molten metal is detected by the response valve.

In a configuration of Japanese Patent No. 5717692, the response valve and the on-off valve are connected by compressed gas filled in a conduit. When the response valve is pressed against the molten metal, the compressed gas filled in the conduit is released to a low-pressure space in which the on-off valve is stored, and a pressure gradient is generated. The on-off valve is displaced by the force of advection current of the compressed gas, and the space is shut off by closing the on-off valve. In a configuration of Japanese Patent No. 4892536, the response valve and the on-off valve are mechanically connected to each other by a lever. When the response valve is pressed against the molten metal, the pressing force is transmitted via the lever, and the space is shut off by closing the on-off valve.

SUMMARY OF THE INVENTION

However, in the configuration of Japanese Patent No. 5717692, it takes a lot of time to fill the conduit with the compressed gas. In addition, since the on-off valve is closed only by the force of advection flow of the compressed gas, it takes time to close the on-off valve, and the responsiveness is low. In the configuration of Japanese Patent No. 4892536, since the lever is deteriorated by the friction generated when the lever presses the on-off valve, a frequent maintenance is required. Further, when the pressing force of the molten metal is insufficient, there is a risk that the lever does not operate or the lever is not operated sufficiently, the on-off valve is not completely closed, and the molten metal is inserted into the suction mechanism.

An object of the present invention is to provide a decompression shut-off valve device with high responsiveness and a method for controlling the same.

(1) According to the present invention, there is provided a decompression shut-off valve device (for example, a decompression shut-off valve device 10 to be described later) provided in a decompression casting apparatus (for example, a decompression casting apparatus 100 to be described later) including an on-off valve (for example, an on-off valve 30 to be described later) which causes a cavity of the decompression casting apparatus to communicate with a decompressing passage (for example, a decompressing passage 15 to be described later) in an open state and shuts off the cavity and the decompressing passage in a closed state; a molten metal position detection unit located downstream of the cavity and including a pressure-receiving section (for example, a pressure-receiving section 52 to be described later) displaced by the pressure of the molten metal; an interlocking member (for example, an interlocking member 60 to be described later) which operates the on-off valve by displacement of the pressure-receiving section; a valve chamber (for example, a valve chamber 31 to be described later) which constitutes a part of the decompressing passage and accommodates the on-off valve and an elastic member (for example, a first return spring S1 to be described later) for urging the on-off valve to the open state side; an accommodating chamber (for example, an accommodating chamber 17 to be described later) which accommodates the interlocking member; and an operation chamber (for example, a cylinder 40 to be described later) which accommodates an enlarged diameter section (for example, an enlarged diameter section 37 to be described later) provided in a rod section (for example, a rod section 33 to be described later) of the on-off valve. The rod section is slidably held through a partition wall (for example, a second partition wall 18 to be described later) which separates the valve chamber and the accommodating chamber, a rod end portion (for example, a rod end portion 36 to be described later) of the rod section which is an end portion on the accommodating chamber side is connected to the molten metal position detection unit via the interlocking member, in the operation chamber, a small diameter low-pressure chamber (for example, a low-pressure chamber 80 to be described later) in which the working fluid is accommodated, and a large diameter high-pressure chamber (for example, a high-pressure chamber 70 to be described later) in which the working fluid having a higher pressure than the low-pressure chamber is accommodated are partitioned by the enlarged diameter section in the open state, and the interlocking member displaces the rod end portion to the closed state side by displacement of the pressure-receiving section to make the low-pressure chamber and the high-pressure chamber communicate with each other.

According to the configuration of (1), the detection pin 50 and the on-off valve 30 are mechanically connected by the interlocking member 60. In addition, the displacement of the on-off valve 30 is caused not only by the mechanical action due to the interlocking member 60 but also by the action of advection flow of the pressure fluid. Therefore, the load of the interlocking member 60 is small as compared with a case where only the mechanical action due to the interlocking member 60 is used. As a result, the durability is improved and the responsiveness is improved.

(2) In this case, it is preferable that the high-pressure chamber have a larger diameter than the low-pressure chamber, and one of surfaces of the enlarged diameter section provided at a boundary surface between the low-pressure chamber and the high-pressure chamber be a spherical surface.

According to the configuration of (2), by making the spherical seal, the contact surface pressure of the boundary surface between the enlarged diameter section and the operation chamber can be increased and the sealing can be reliably performed.

(3) In this case, it is preferable that a decompression unit (for example, a vacuum pump 21 to be described later) for sucking air and a compression unit (for example, a compression pump 24 to be described later) for supplying air be connected to the decompressing passage in a switchable manner.

According to the configuration of (3), the pressure of the overflow section 13 can be freely changed.

(4) According to the present invention, there is provided a decompression shut-off valve device provided in a decompression casting apparatus including an on-off valve which causes a cavity of the decompression casting apparatus to communicate with a decompressing passage in an open state and shuts off the cavity and the decompressing passage in a closed state; a molten metal position detection unit located downstream of the cavity and including a pressure-receiving section displaced by the pressure of the molten metal; an interlocking member which operates the on-off valve by displacement of the pressure-receiving section; a valve chamber which constitutes a part of the decompressing passage and accommodates the on-off valve and an elastic member for urging the on-off valve to the open state side; an accommodating chamber which accommodates the interlocking member; and an operation chamber which accommodates an enlarged diameter section provided in the rod section of the on-off valve. The rod section is slidably held through a partition wall which separates the valve chamber and the accommodating chamber, a rod end portion of the rod section which is an end portion on the accommodating chamber side is connected to the molten metal position detection unit via the interlocking member, in the operation chamber, a small diameter low-pressure chamber in which the working fluid is accommodated, and a large diameter high-pressure chamber in which the working fluid having a higher pressure than the low-pressure chamber is accommodated are partitioned by the enlarged diameter section in the open state. According to the present invention, a method for controlling the decompression shut-off valve device includes a decompression process of setting the on-off valve to the open state at the start of casting and decompressing the cavity; an initial stage process of setting the high-pressure chamber to a higher pressure than the low-pressure chamber; a pressure-receiving member displacing process in which the pressure-receiving section is displaced by a molten metal pressure; a rod section operating process in which the interlocking member is displaced by displacement of the pressure-receiving section and the rod end portion is displaced to the closed state side; and an on-off valve closing process in which the enlarged diameter section is displaced by the displacement of the rod end portion toward the closed state side, the working fluid in the high-pressure chamber flows into the low-pressure chamber, and the on-off valve is in the closed state.

According to the controlling method of (4), the detection pin 50 and the on-off valve 30 are mechanically connected by the interlocking member 60. In addition, the displacement of the on-off valve 30 is caused not only by the mechanical action due to the interlocking member 60 but also by the action of advection flow of the pressure fluid. Therefore, the load of the interlocking member 60 is small as compared with a case where only the mechanical action due to the interlocking member 60 is used. As a result, the durability is improved and the responsiveness is improved.

(5) In this case, a decompression unit for sucking air and a compression unit for supplying air may be connected to the decompressing passage in a switchable manner, and the controlling method preferably further includes an initial position returning process of the molten metal position detection unit for connecting the decompressing passage and the compression unit and supplying pressurized air, after the on-off valve closing process; and an initial position returning process of the on-off valve for removing pressure in the operation chamber.

According to the configuration of (5), the on-off valve is always returned to the initial position.

According to the present invention, it is possible to provide a decompression shut-off valve device having high responsiveness and a method for controlling the same.

DETAILED DESCRIPTION OF THE INVENTION

Figure 1:
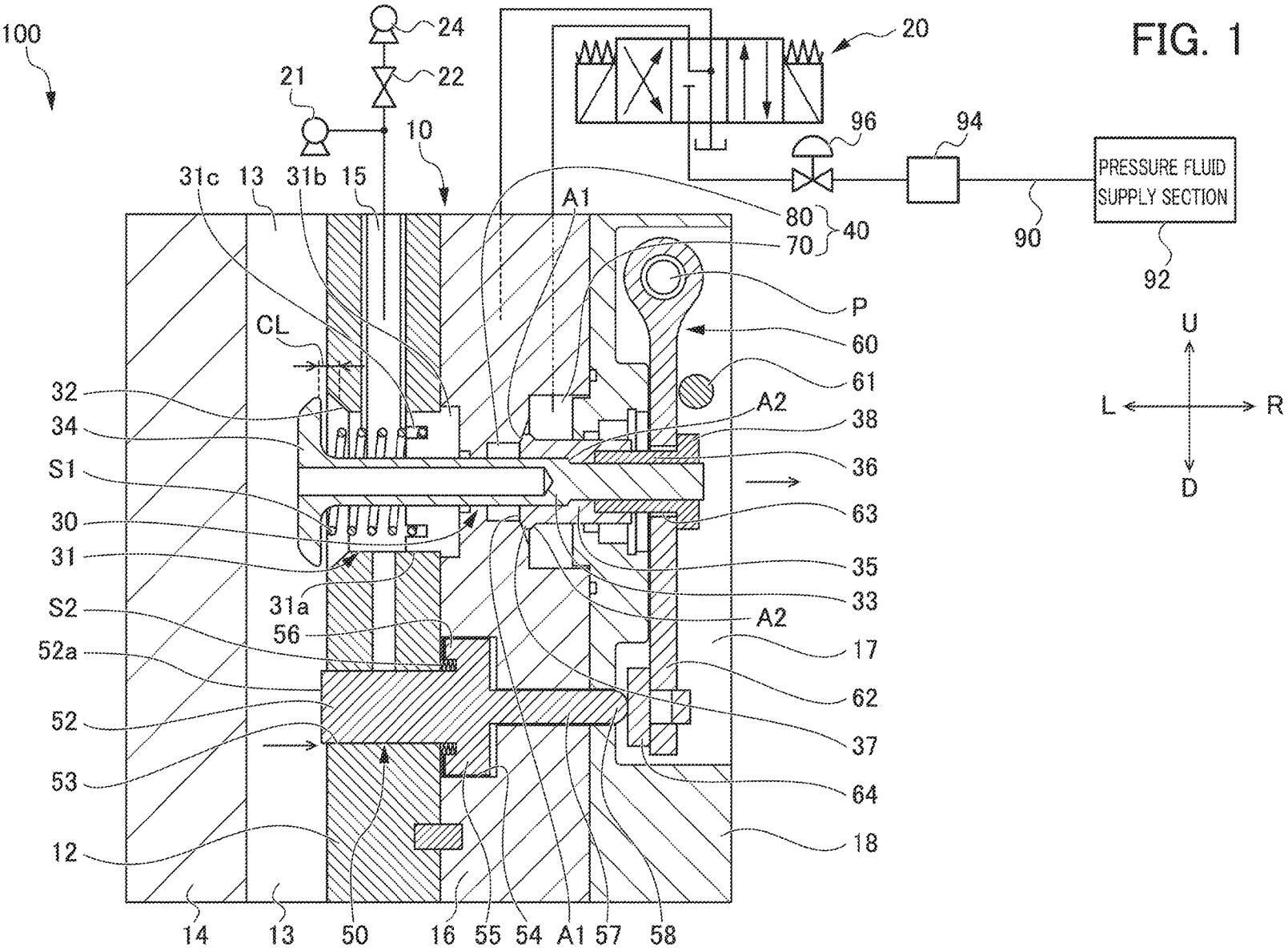
FIG. 1 is a cross-sectional view illustrating a communicating state of a decompression shut-off valve device according to an embodiment of the present invention.
Figure 2:
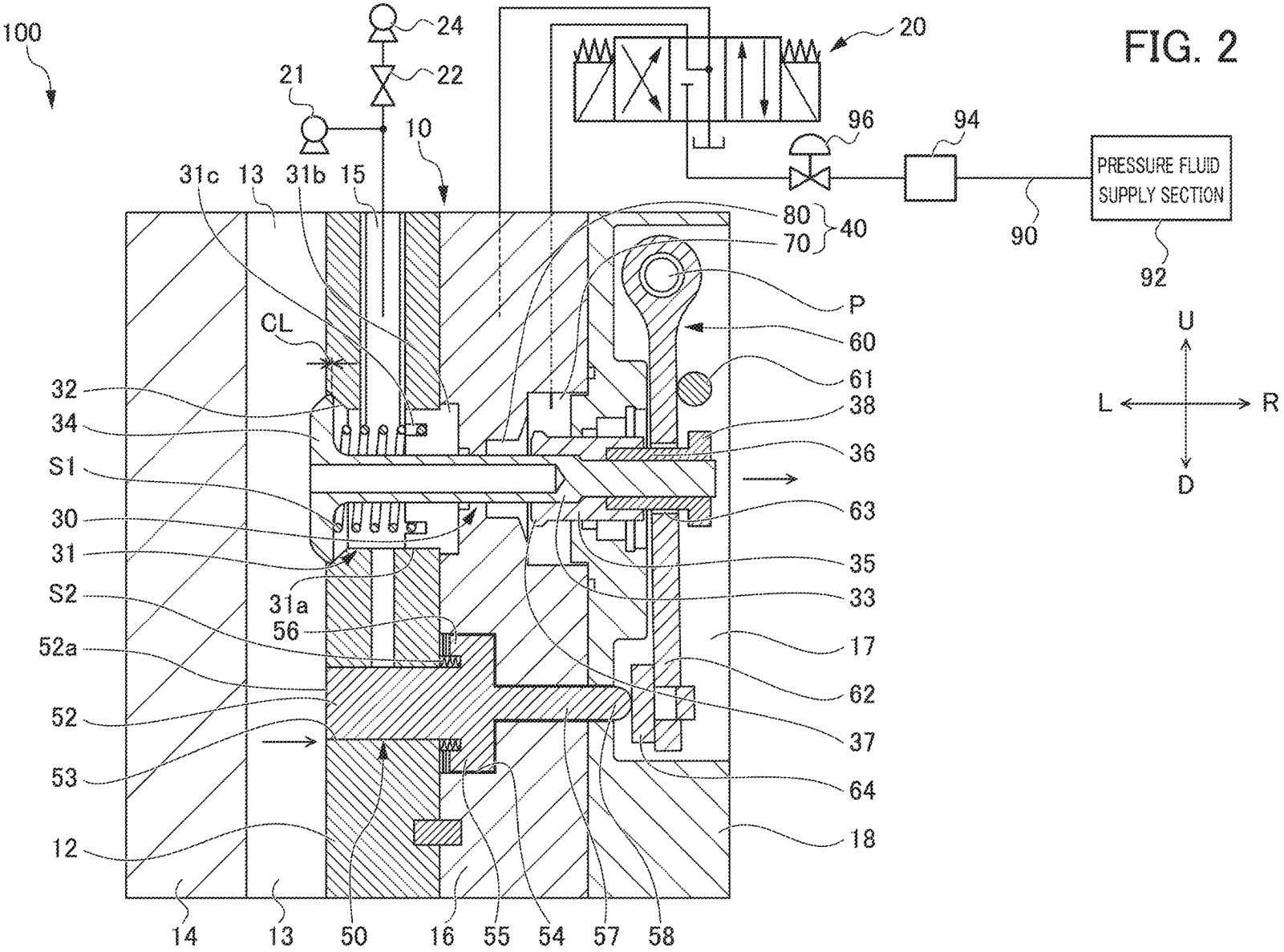
FIG. 2 is a cross-sectional view illustrating a shut-off state of the decompression shut-off valve device according to an embodiment of the present invention.

Hereinafter, a decompression shut-off valve device and an operating method of the decompression shut-off valve which is a method for controlling the same according to the present invention will be described with reference to the drawings. FIGS. 1 and 2 are cross-sectional views illustrating a configuration of a decompression shut-off valve device 10 according to an embodiment of the present invention, and a decompression casting apparatus 100 to which the decompression shut-off valve device 10 is applied. More specifically, FIG. 1 illustrates a communicating state of the decompression shut-off valve device 10, and FIG. 2 illustrates a shut-off state of the decompression shut-off valve device 10.

The decompression casting apparatus 100 includes a fixed die 12, a movable die 14 provided to be freely movable forward and backward by a slide cylinder (not illustrated) with respect to the fixed die 12, a decompression shut-off valve device 10 provided in the fixed die 12, and a molten metal supply device (not illustrated) which supplies molten metal of metal (for example, aluminum) into a cavity (not illustrated) formed between the fixed die 12 and the movable die 14. The cavity is formed by bringing the movable die 14 close to the fixed die 12 and closing the die. The molten metal filled in the cavity flows into an overflow section 13. Hereinafter, in an orthogonal coordinate in the drawings, "L" is defined by a left side, "R" is defined by a right side, "U" is defined by an upper side, and "D" is defined by a lower side.

The configuration and operation of the decompression shut-off valve device 10 will be outlined. The decompression shut-off valve device 10 is provided, for example, in a decompressing passage 15 formed in the fixed die 12. The decompressing passage 15 is a space formed in the fixed die 12. An on-off valve 30 is provided in the decompressing passage 15. As illustrated in FIG. 1, when the on-off valve 30 is in an open state, the decompressing passage 15 and the cavity are in a communicating state. In the communicating state, when the atmospheric air of the decompressing passage 15 is sucked by a vacuum pump 21, the atmospheric air of the cavity is also sucked and decompressed.

A detection pin 50 is attached to the lower side of the on-off valve 30. The detection pin 50 is mechanically connected to the on-off valve 30 via an interlocking member 60. The molten metal to be injected into the overflow section 13 comes into contact with a pressure-receiving section 52 of the detection pin 50.

As illustrated in FIG. 2, when the molten metal rises from the lower side and comes into contact with the pressure-receiving section 52, the pressure-receiving section 52 is displaced in a pressing direction indicated by an arrow, that is, to a right side. Along with the displacement of the pressure-receiving section 52, the interlocking member 60 displaces the connected on-off valve 30 to the right side. As will be described in detail below, the displacement of the on-off valve 30 is promoted by the force generated by the advection flow of the working fluid of a cylinder 40. By the rightward displacement of the on-off valve 30, the on-off valve 30 is in a closed state, and the decompressing passage 15 and the overflow section 13 are shut off. In the shut off state, the molten metal does not enter the vacuum pump 21 provided in the decompressing passage 15.

Hereinafter, details of each member provided in the decompression shut-off valve device 10, that is, the on-off valve 30, the detection pin 50, and the interlocking member 60 will be described. The on-off valve 30 penetrates a valve chamber 31 communicating with the decompressing passage 15, a first partition wall 16 for separating the cylinder 40 and the valve chamber 31 from each other, the cylinder 40, and a second partition wall 18 for separating the cylinder 40 and an accommodating chamber 17 from each other, and is slidably held.

A valve section 34 is formed at one end of the on-off valve 30. A connecting member 35 is integrally formed on a rod section 33 extending from the valve section 34. A rod end portion 36 is fitted into a distal end of the connecting member 35. The rod end portion 36 is fixed relative to the rod section 33. An on-off valve side flange section 38 is formed at the distal end of the rod end portion 36. That is, the valve section 34, the rod section 33, the connecting member 35, and the rod end portion 36 are coaxial, and their relative positions are fixed. The connecting member 35 is, for example, a metal piston.

The valve chamber 31 includes a valve seat 32, a cylinder section 31*a*, and a flange section 31*b*. The valve seat 32 has a tapered shape that decreases in diameter toward the decompressing passage 15. The cylinder section 31*a* has the same diameter as a minimum diameter of the valve seat 32. The cylinder section 31*a* penetrates the fixed die 12 and is formed to communicate with the valve seat 32 and the decompressing passage 15. The flange section 31*b* is engaged with the surface of the fixed die 12 on the first partition wall 16 side, and the valve chamber 31 is fixed to the fixed die 12 accordingly.

In an initial state, that is, in the open state of the on-off valve 30, the valve section 34 is urged by a first return spring S1 screwed into the rod section 33 at a position corresponding to the cylinder section 31*a*. One end of the first return spring S1 abuts on the valve section 34, and the other end thereof abuts on a gap 31*c* formed on the inner peripheral surface of the cylinder section 31*a*.

The detection pin 50 is provided in the lower side of the on-off valve 30. The detection pin 50 has the pressure-receiving section 52, a stroke section 55, and an elongated section 57. The detection pin 50 is slidably attached to the fixed die 12 by the pressure-receiving section 52 being pivotally supported by a penetration hole 53 formed in the fixed die 12. A pressure-receiving surface 52*a* of the pressure-receiving section 52 is exposed to the overflow section 13 of the movable die 14.

The stroke section 55 having a diameter larger than that of the pressure-receiving section 52 is formed on a surface opposite to the pressure-receiving surface 52*a* of the pressure-receiving section 52. A detection pin side flange section 56 is formed on the fixed die 12 side of the stroke section 55. The stroke section 55 is stored in a stroke chamber 54 formed in the first partition wall 16 and is urged by a second return spring S2 in the initial state. One end of the second return spring S2 abuts on the side surface of the fixed die 12, and the other end thereof abuts on the end surface of the detection pin side flange section 56. The second return spring S2 has a spring coefficient smaller than the first return spring S1. The elongated section 57 having a diameter smaller than that of the stroke section 55 and having an elongated shape is formed in the stroke section 55. That is, the pressure-receiving section 52, the stroke section 55, and the elongated section 57 are integrally formed coaxially.

The interlocking member 60 is stored in the accommodating chamber 17 separated from the cylinder 40 via the second partition wall 18. The interlocking member 60 is rotatably held around a fulcrum P. The interlocking member 60 has a connecting section 62 extending downward from the fulcrum P. When the connecting section 62 comes into contact with an engagement section 61, a rotation angle of the interlocking member 60 is restricted.

A penetration hole 63 centered on the axis of the on-off valve 30 is formed in the connecting section 62. The rod end portion 36 is inserted into the penetration hole 63 with a predetermined gap. The on-off valve side flange section 38 has a function of abutting on the outer periphery of the penetration hole 63 to prevent the on-off valve 30 from coming off from the penetration hole 63. An abutting section 64 is formed at the lower end of the connecting section 62 on the elongated section 57 side. The abutting section 64 abuts on a distal end portion 58 of the elongated section 57 in the initial state.

The cylinder 40 is formed coaxially with the on-off valve 30 between the second partition wall 18 and the first partition wall 16. The cylinder 40 as an operation chamber is provided with a high-pressure chamber 70 and a low-pressure chamber 80. The high-pressure chamber 70 is formed at a position corresponding to the connecting member 35 of the on-off valve 30. In the initial state, the high-pressure chamber 70 and the low-pressure chamber 80 are sealed off and shut off by an enlarged diameter section 37.

In the operation chamber, the high-pressure chamber 70 is formed in a large diameter with respect to the low-pressure chamber 80. It is desirable that one of a boundary surface between the high-pressure chamber 70 and the low-pressure chamber 80 or a surface being in contact with the boundary surface of the enlarged diameter section 37 be configured as a spherical surface. By adopting a spherical seal structure, it is possible to minimize a contact area at the boundary surface between the enlarged diameter section 37 and the operation chamber, and to increase the surface pressure.

Thus, the sealing can be reliably performed. In addition, the diameter of the enlarged diameter section 37 is substantially equal to the diameter of the connecting member 35. The enlarged diameter section 37 forms a so-called spherical seal, but if it is assumed that the spherical surface on the low-pressure chamber 80 side is a surface A1 and the spherical surface on the high-pressure chamber 70 side is a surface A2, it is desirable that the areas of the surface A1 and the surface A2 be equal. As a result, the fluid load can be canceled. Furthermore, in order to generate a large surface pressure, it is desirable that the contact area between the surface A1 and the first partition wall 16 be set small.

The working fluid is supplied to the high-pressure chamber 70 from a pressure fluid supply section 92 via a supply line 90. For example, oil is used as a working fluid, but the present invention is not limited thereto. The working fluid may be air. The working fluid supplied from the pressure fluid supply section 92 passes through a filter 94, the pressure thereof is regulated by a regulator 96, and then the working fluid flows into the high-pressure chamber 70 by opening of the supply valve. The low-pressure chamber 80 is connected to a four-port valve 20 via a flow passage (not illustrated). A suction mechanism, for example, the vacuum pump 21 and a compression pump 24 are attached to the decompressing passage 15. A switching valve 22 is provided between the vacuum pump 21 and the compression pump 24, and the suction function and the compression function are switched by the switching valve 22.

Figure 3:
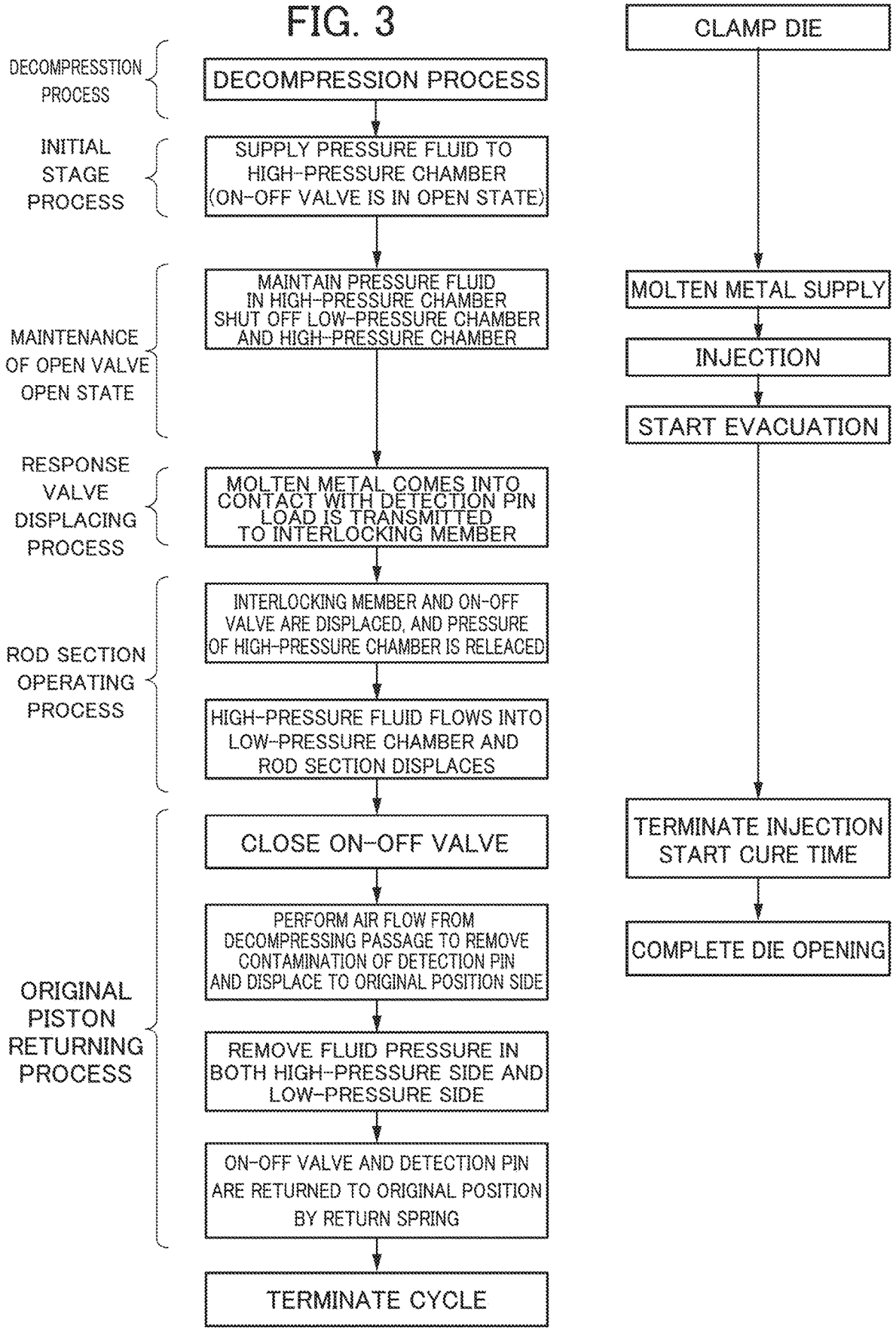
FIG. 3 is a sequence illustrating a method of operating a decompression shut-off valve according to an embodiment of the present invention.

FIG. 3 is a diagram describing an operating method of the decompression shut-off valve device 10. A sequence on the left side of FIG. 3 illustrates each process of the operating method of the decompression shut-off valve device 10, and a sequence on the right side of FIG. 3 illustrates the casting process. The time series of the sequence on the left side and the sequence on the right side correspond as illustrated.

First, the cavity is formed by abutting the movable die 14 on the fixed die 12 and closing the dies. Furthermore, the thrust force with respect to the movable die 14 is increased, and clamping is performed. Thereafter, the vacuum pump 21 (see FIG. 1) is operated, the supply valve is opened, and the working fluid is supplied from the pressure fluid supply section 92 to the high-pressure chamber 70. When foreign matter is mixed in the working fluid, the foreign matter is removed by the filter 94.

As indicated by a "decompression process" in the drawing, the vacuum pump 21 decompresses the inside of the cavity via the decompressing passage 15. Further, as illustrated by an "initial stage process" in the drawing, the high-pressure chamber 70 and the low-pressure chamber 80 are shut off by the enlarged diameter section 37. Therefore, when the working fluid is supplied to the high-pressure chamber 70, the pressure in the high-pressure chamber 70 rises, but the pressure in the low-pressure chamber 80 does not change. Since the low-pressure chamber 80 is maintained in a non-pressurized state, the pressure in the low-pressure chamber 80 is relatively lower than the pressure in the high-pressure chamber 70. At this time, the on-off valve 30 is urged by the first return spring S1, and a clearance CL is maintained in a state in which it is a positive value, that is, it is maintained in the open state.

When the supply of the working fluid to the high-pressure chamber 70 is completed, molten metal supply and injection of the molten metal are performed. As illustrated by a "maintenance of open valve open state" in the drawing, when the on-off valve 30 is in the open state, the cavity is in a state of communicating with the decompressing passage 15. Therefore, when the atmospheric air of the decompressing passage 15 is sucked by the vacuum pump 21, evacuation of the cavity is started.

As illustrated by a "response valve displacing process" in the drawing, when the molten metal supply advances, the molten metal rises from the lower side and reaches the pressure-receiving surface 52*a* of the pressure-receiving section 52. The molten metal presses the pressure-receiving surface 52*a* in a direction of the arrow illustrated in FIG. 2, that is, to the right side. When the pressure-receiving surface 52*a* is pressed, the pressure-receiving section 52 is displaced, and the distal end portion 58 of the elongated section 57 presses the abutting section 64. When the abutting section 64 is pressed, the pressing force thereof is transmitted to the connecting section 62 and acts as a force of a minute rotary motion about the fulcrum P of the interlocking member 60.

As illustrated by a "rod section operation process" in the drawing, the on-off valve side flange section 38 which engages with the penetration hole 63 of the interlocking member 60 is displaced in the direction of the arrow in the drawing, along with the minute rotational movement of the interlocking member 60. When the on-off valve side flange section 38 is displaced, the connecting member 35 integrally formed with the rod end portion 36 is also displaced by the same amount.

At this time, the enlarged diameter section 37 which seals the space between the high-pressure chamber 70 and the low-pressure chamber 80 is also displaced by the same amount. When the enlarged diameter section 37 is displaced, the working fluid of the high-pressure chamber 70 is advected to the low-pressure chamber 80. Displacement of the connecting member 35 is promoted by the force generated by the advection flow. That is, according to the present invention, since the amount of displacement caused by advection flow is set to be larger than the amount of displacement of the rod end portion 36 due to the interlocking member 60, even if the molten metal pressure applied to the pressure-receiving surface 52*a* of the detection pin 50 changes, the amount of movement of the on-off valve 30 is not influenced by the amount of rotation of the interlocking member 60. Therefore, even if the molten metal pressure is low, it is possible to reliably close the on-off valve 30 promptly. Further, since the diameter of the enlarged diameter section 37 is substantially the same as the diameter of the connecting member 35, even when the load of the molten metal fluctuates, the load applied to the right direction by the fluid pressure is canceled.

As illustrated by an "on-off valve closing process" in the drawing, the on-off valve 30 is displaced until the clearance CL becomes zero, and is in the closed state. As a result, the on-off valve 30 is in the closed state, and the decompressing passage 15 and the cavity are shut off. At the moment when the on-off valve 30 is in the closed state, that is, when the valve section 34 collides with the valve seat 32, there is a risk of rebounding of the valve section 34 in the direction opposite to the collision direction. However, since the fluid pressure is surged by the four-port valve 20, the rebounding is prevented.

When the injection of the molten metal is finished, the cure time starts. When the cure time is finished, the die opening is completed and the product is extracted. Thereafter, the on-off valve 30 and the detection pin 50 return to the state of the initial stage process illustrated in FIG. 1. That is, when the working fluid in the high-pressure chamber 70 and the low-pressure chamber 80 communicating with each other is discharged, the valve section 34 of the on-off valve 30 is urged by the first return spring S1 to be in the open state. As the stroke section 55 of the detection pin 50 is urged by the second return spring S2, the distal end portion 58 comes into contact with the abutting section 64 and is returned to an initial position.

As illustrated by an "original position returning process" in the drawing, the on-off valve 30 and the detection pin 50 are returned to their initial positions. At this time, since the molten metal supplied to the overflow section 13 is inserted into the gap between the fixed die 12 and the detection pin 50, and becomes a resistance, there is a possibility that the detection pin 50 does not correctly return to the original position. Thus, in order to solve this problem, in the invention of the present application, high-pressure air is air-blown for a predetermined time from the decompressing passage 15 which sucks the air inside the cavity at the initial stage of the original position returning process.

Since the on-off valve 30 is at the closed position in the initial stage of the original position returning process, the air blow is supplied to the gap between the detection pin 50 and the fixed die 12 without leaking from the on-off valve 30, and the burr due to the molten metal inserted by air blow is discharged. Since the fixed die 12 and the movable die 14 are opened, the discharged burr is discharged to the outside of the die. At this time, it is more desirable that a seal member such as an O-ring be provided between the elongated section 57 of the detection pin 50 and the second partition wall 18.

With this configuration, since the area of the R direction surface of the stroke section 55 of the detection pin 50 is larger than the area of the L direction surface, a force moving forward in the L direction is imparted to the stroke section 55. Further, the detection pin 50 is returned to the proper original position by the pressure of the air blow supplied to the stroke chamber 54 and the urging force of the second return spring S2.

After the detection pin 50 is returned to the original position, the air blow is stopped and the working fluid pressure in the high-pressure chamber 70 and the low-pressure chamber 80 is removed. By the series of operations, the on-off valve 30 is returned to its original position by the urging force of the first return spring S1.

According to the present embodiment, the following effects are obtained. According to the above-described embodiment, in the mechanical control of the decompression shut-off valve device 10, the durability is improved and the responsiveness is improved. That is, although the detection pin 50 and the on-off valve 30 are mechanically connected to each other by the interlocking member 60, the displacement of the on-off valve 30 is caused not only by the mechanical action due to the interlocking member 60 but also by the action of advection flow of the pressure fluid. Therefore, the load of the interlocking member 60 is small as compared with a case where only the mechanical action due to the interlocking member 60 is used. In addition, since the pressing force due to the molten metal acts on the distal end of the interlocking member 60, a distance of an action line from the fulcrum P, which is the rotation center of the interlocking member 60, is long, and as a result, the on-off valve 30 can be displaced even with a minute pressing force. Furthermore, since the displacement is promoted by the action of the advection flow of the pressure fluid, the responsiveness is higher than a configuration in which the on-off valve 30 is displaced only by the interlocking member 60.

What is claimed is:

1. A decompression shut-off valve device provided in a decompression casting apparatus comprising:

an on-off valve which causes a cavity of the decompression casting apparatus to communicate with a decompressing passage in an open state and shuts off the cavity and the decompressing passage in a closed state;

a molten metal position detection unit located downstream of the cavity and including a pressure-receiving section displaced by a pressure of a molten metal;

an interlocking member which operates the on-off valve by displacement of the pressure-receiving section;

a valve chamber which constitutes a part of the decompressing passage and accommodates the on-off valve and an elastic member for urging the on-off valve to an open state side;

an accommodating chamber which accommodates the interlocking member; and an operation chamber which accommodates an enlarged diameter section provided in a rod section of the on-off valve, wherein the rod section is slidably held through a partition wall which separates the valve chamber and the accommodating chamber, a rod end portion of the rod section which is an end portion on an accommodating chamber side is connected to the molten metal position detection unit via the interlocking member, in the operation chamber, a small diameter low-pressure chamber in which a working fluid is accommodated, and a large diameter high-pressure chamber in which the working fluid having a higher pressure than the low-pressure chamber is accommodated are partitioned by the enlarged diameter section in the open state, and the interlocking member displaces the rod end portion to a closed state side by displacement of the pressure-receiving section to make the low-pressure chamber and the high-pressure chamber communicate with each other.

2. The decompression shut-off valve device according to claim 1, wherein the high-pressure chamber has a larger diameter than the low-pressure chamber, and one of surfaces of the enlarged diameter section provided at a boundary surface between the low-pressure chamber and the high-pressure chamber is a spherical surface.

3. The decompression shut-off valve device according to claim 2, wherein a decompression unit for sucking air and a compression unit for supplying air are connected to the decompressing passage in a switchable manner.

4. The decompression shut-off valve device according to claim 1, wherein a decompression unit for sucking air and a compression unit for supplying air are connected to the decompressing passage in a switchable manner.

5. A method for controlling a decompression shut-off valve device provided in a decompression casting apparatus, wherein the decompression shut-off valve device includes:

an on-off valve which causes a cavity of the decompression casting apparatus to communicate with a decompressing passage in an open state and shuts off the cavity and the decompressing passage in a closed state;

a molten metal position detection unit located downstream of the cavity and including a pressure-receiving section displaced by a pressure of a molten metal;

an interlocking member which operates the on-off valve by displacement of the pressure-receiving section;

a valve chamber which constitutes a part of the decompressing passage and accommodates the on-off valve and an elastic member for urging the on-off valve to an open state side;

an accommodating chamber which accommodates the interlocking member; and an operation chamber which accommodates an enlarged diameter section provided in a rod section of the on-off valve, the rod section is slidably held through a partition wall which separates the valve chamber and an accommodating chamber, a rod end portion of the rod section which is an end portion on the accommodating chamber side is connected to the molten metal position detection unit via the interlocking member, in the operation chamber, a small diameter low-pressure chamber in which a working fluid is accommodated, and a large diameter high-pressure chamber in which the working fluid having a higher pressure than the low-pressure chamber is accommodated are partitioned by the enlarged diameter section in the open state, and the controlling method comprises:

setting the on-off valve to the open state at a start of casting and decompressing the cavity;

setting the high-pressure chamber to a higher pressure than the low-pressure chamber;

displacing the pressure-receiving section by a molten metal pressure;

displacing the rod end portion to the closed state side by displacing the interlocking member and the pressure-receiving section;

displacing the enlarged diameter section by displacing the rod end portion toward the closed state side; and closing the on-off valve by causing the working fluid in the high-pressure chamber to flow into the low-pressure chamber.

6. The method for controlling a decompression shut-off valve device according to claim 5, wherein a decompression unit for sucking air and a compression unit for supplying air are connected to the decompressing passage in a switchable manner, and the controlling method further comprises:

connecting the decompressing passage and the compression unit, after closing the on-off valve;

returning the molten metal position detection unit to an initial position by supplying pressurized air; and returning the on-off valve to an initial position by removing pressure in the operation chamber.

* * * * *